US005424620A

United States Patent [19]

Cheon et al.

[11] Patent Number: 5,424,620

[45] Date of Patent: Jun. 13, 1995

[54] DISPLAY APPARATUS FOR DISPLAYING PICTURES VIRTUALLY INSTANTANEOUSLY

[75] Inventors: Bak-mee Cheon; Kwang-hoon Jeong, both of Suwon, Rep. of Korea

[73] Assignee: Samsung Electronics Co., Ltd., Kyungki-do, Rep. of Korea

[21] Appl. No.: 174,323

[22] Filed: Dec. 30, 1993

[30] Foreign Application Priority Data

Oct. 11, 1993 [KR] Rep. of Korea ..... 93-21001

[51] Int. Cl.[6] ..... H01J 29/70

[52] U.S. Cl. ..... 315/411; 313/346 DC

[58] Field of Search ..... 315/411; 313/346 DC

[56] References Cited

U.S. PATENT DOCUMENTS

| | | | |
|---|---|---|---|
| 3,783,335 | 1/1974 | Gries . | |
| 4,145,639 | 3/1979 | Willis | 315/411 |
| 4,649,325 | 3/1987 | Guerin et al. | 315/383 |
| 5,295,887 | 3/1994 | Zdanowski | 445/63 |
| 5,306,189 | 4/1994 | Sugimura et al. | 445/50 |

*Primary Examiner*—Theodore M. Blum

*Attorney, Agent, or Firm*—Sughrue, Mion, Zinn, Macpeak & Seas

[57] ABSTRACT

A display apparatus for displaying pictures virtually instantaneously adopts a direct-heating type cathode of an impregnated structure, and includes a cathode ray tube having a dispenser cathode wherein a cathode material is filled in pores of a porous body and a porous heater is directly connected to the cathode material. A voltage generator of the apparatus produces a first voltage for driving the heater. A video signal supply portion supplies a video signal to the cathode, while a deflector deflects horizontally and vertically an electron beam generated from the cathode to produce a raster by scanning the fluorescent surface of the cathode ray tube. A flyback transformer generates a second voltage to be supplied to the anode and one or more grids of the cathode ray tube using a horizontal deflection output signal supplied from the deflector. With the described arrangement, an electron-emitting velocity of an electron gun reaches its maximum value within about one second after power is applied. Thus, the display apparatus can be adapted to an HDTV requiring high current density electron-emitting characteristics.

4 Claims, 4 Drawing Sheets

FIG. 3
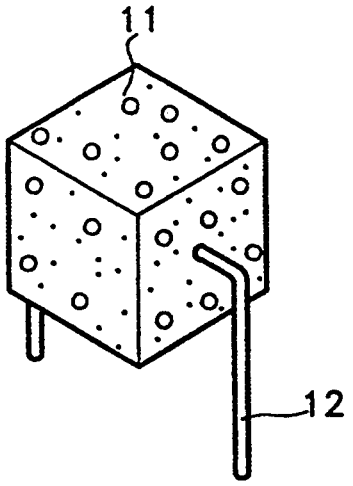
FIG. 5A
FIG. 5B
FIG. 5C
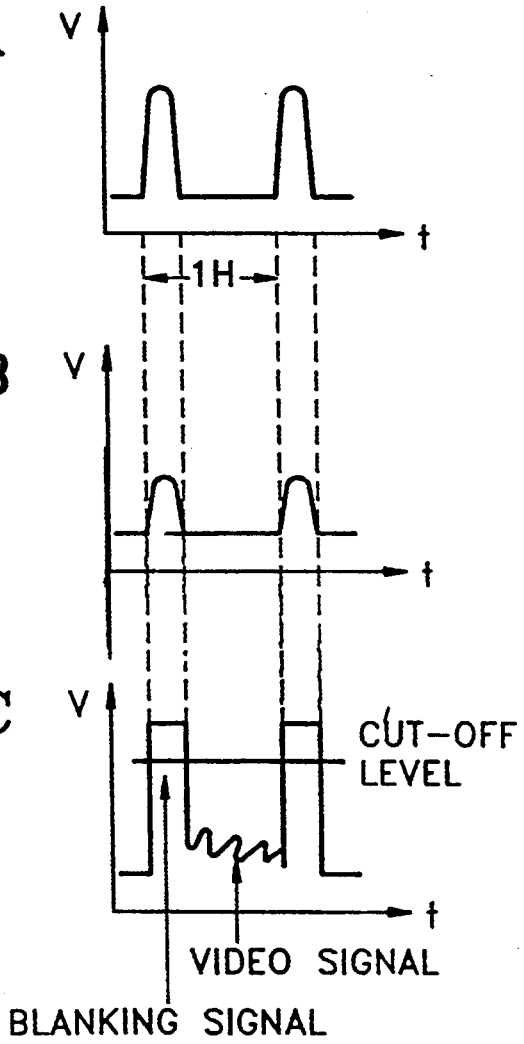

DISPLAY APPARATUS FOR DISPLAYING PICTURES VIRTUALLY INSTANTANEOUSLY

The following disclosure is based on Republic of Korea Patent Application Number 93-21001, filed on Oct. 11, 1993.

BACKGROUND OF THE INVENTION

The present invention relates to a display apparatus, and more particularly, to a display apparatus which comprises a direct-heating type cathode of an impregnated structure for displaying pictures virtually instantaneously after the apparatus is turned on.

Generally, display apparatuses can be formed as monitors, televisions, liquid crystal displays, etc. Among these options, the monitor and the television include a cathode ray tube (CRT) and a CRT driving circuit, for displaying pictures on a screen.

Generally, a cathode for use in the CRT emits thermions by heat energy. Such cathodes are largely classified into two groups, namely, a heat-emissive type cathode, which is an indirect-heating type cathode, and a direct-heating type cathode. As shown in FIG. 1, the indirect-heating type cathode has a structure in which the heater is separated from the cathode. A display apparatus adopting such a heat-emissive type cathode is shown in FIG.2. Here, a color television has been adopted as the display apparatus.

Referring to FIGS. 1 and 2, if the power switch of the color television is turned on, power is applied to a heater 4. Then, heater 4, formed of tungsten material on which an insulation material 41 is coated, generates heat after a few seconds. In this case, if leakage current flows between a base metal 1 forming the cathode and heater 4, heater 4 can be destroyed, or a video signal voltage and a cut-off voltage applied to cathode 1 may vary. Accordingly, insulation material 41 is used for avoiding the leakage of current between heater 4 and cathode 1.

In the case of a color CRT, a flyback pulse voltage or a direct voltage is used as the power applied in order to heat up heater 4. The flyback pulse has a voltage value of e.g., 6.3 Vrms and a current value of 600–700 mArms, which is produced from the secondary winding of a flyback transformer (not shown). Here, the power consumption is about 4.4 watts.

Heat generated by heater 4 is transmitted to a cathode sleeve 2, a base metal 1 and a holder 3 in sequence by radiation and conduction, so that an electron-emitting substance 11, coated on base metal 1, is heated up until the electron-emitting substance 11 reaches a normal operating temperature, that is, a proper temperature for emitting thermions.

Thus, since the cathode of the cathode-ray tube used in the conventional display apparatus is a heat-emissive type cathode separated from the heater, heater 4, as a heat source, is spaced at a predetermined distance from a carbonate, as the electron-emitting substance 11. Therefore, the electron-emitting substance 11 is heated up gradually, so that it takes a predetermined time (about ten seconds) until the electron-emitting substance reaches a normal operating state. Consequently, cathode-ray tubes utilizing the heat-emissive type cathode have a drawback in that the time required to display pictures becomes overly long.

Also, the respective initial times for emitting the thermions by plural cathodes may fail to coincide, e.g., in a situation where three cathodes respectively corresponding to red (R), green (G) and blue (B) signals are provided. Also, another drawback may arise in that the picture's white balance may be distorted (for instance, if the cathode corresponding to the R signal emits thermions faster than those for the G and B signals, the whole image shows a red tint), such that the initial quality of the image is lowered. Further, since it takes a relatively long time for the overall white balance to adjust, problems arise in efficiency of the manufacturing process.

Also, since a carbonate is usually used as the electron-emitting substance for heat-emissive type cathodes, when a high current is applied thereto, joule heat is generated therein, which is undesirable. Therefore, heat-emissive type cathodes cannot be used in high-definition televisions (HDTV), which should be operated at a high current density.

To solve the above problems, a direct-heating type cathode has been developed wherein the thermions are emitted from the electron-emitting substance in a short time, so that the initial time required for displaying images in the CRT can be reduced.

FIG.3 is a detailed view of a cathode portion where a filament 12 is secured to a cathode matrix 11 having an impregnated structure. Such a cathode portion is useful in direct-heating type cathodes. A detailed explanation of the portion shown in FIG.3 is disclosed in Korean patent application No.91-9461 for the invention entitled "A Direct-heating Type Cathode of an Electron Gun for a Cathode Ray Tube and the Manufacturing Method Thereof." by Samsung Display Devices Co., Ltd.

To summarize the contents of the above Korean patent application, a direct-heating type cathode mounted in the electron gun for use in the CRT to emit thermions is formed of a cathode matrix 11, into which the electron-emitting substance, e.g., cesium, is impregnated. A heater 12 made of an alloy of molybdenum (Mo) and rhenium (Re) is welded to the cathode matrix 11. After power is applied thereto, heat generated from heater 12 is transmitted to cathode matrix 11 directly. Accordingly, the thermal efficiency in which heat is transmitted from heater 12 to cathode matrix 11 can be enhanced. This, in turn allows the portion to be adapted to HDTV systems requiring electron-emitting characteristics of high current density, and reduces the time needed for displaying pictures in the CRT.

Since monochrome CRTs have only one cathode, video signals can be overlapped in a G1 grid (FIG.2) of the CRT. However, when a CRT having one or more cathodes, especially a color CRT, adopts a direct-heating type cathode of an impregnated structure, where the cathode electrically contacts the heater, as shown in FIG.3, only a few methods are available in which both the video signal overlapped with the cut-off voltage and the power for driving the heater can be applied simultaneously.

SUMMARY OF THE INVENTION

In order to solve the above problems, an object of the present invention is to provide a display apparatus for displaying pictures without an appreciable delay. Specifically, it is desired to provide a display apparatus in which the electron emission speed of an electron gun reaches a maximum value within about one second after power is applied, by driving a direct-heating type cathode of an impregnated structure, using a secondary voltage of a flyback transformer which transforms a primary voltage at a predetermined turn ratio.

To accomplish the above object, a display apparatus for displaying pictures according to the present invention comprises:

a cathode ray tube having a dispenser cathode wherein a cathode material is filled in pores of a porous body and a porous heater is directly connected to the cathode material;

a voltage generator which produces a first voltage for driving the heater;

means for supplying a video signal to the cathode;

deflection means for deflecting horizontally and vertically an electron beam generated from the cathode to produce a raster by scanning the fluorescent surface of the cathode ray tube; and a flyback transformer for generating a second voltage so as to be supplied to the anode and one or more grids of the cathode ray tube using a horizontal deflection output signal supplied from the deflection means.

BRIEF DESCRIPTION OF THE DRAWINGS

The above and other objects and advantages of the present invention will become more apparent by describing in detail a preferred embodiment thereof with reference to the attached drawings in which:

FIG.3 shows a structure of a direct-heating type cathode having an impregnated structure;

FIGS. 5A through 5C show waveforms present at respective portions of the apparatus shown in FIG.4;

DETAILED DESCRIPTION OF THE INVENTION

Hereinafter, the present invention is explained in detail, referring to the accompanying drawings.

Figure 1:
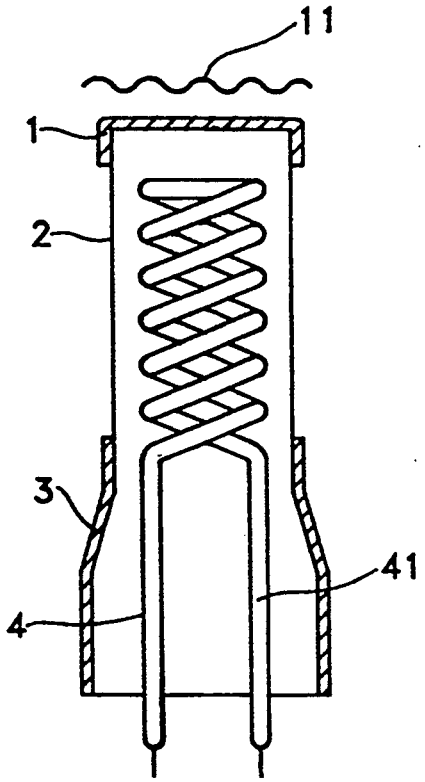
FIG. 1 (PRIOR ART)
FIG.1 shows a structure of a general heat-emissive type cathode.
Figure 2:
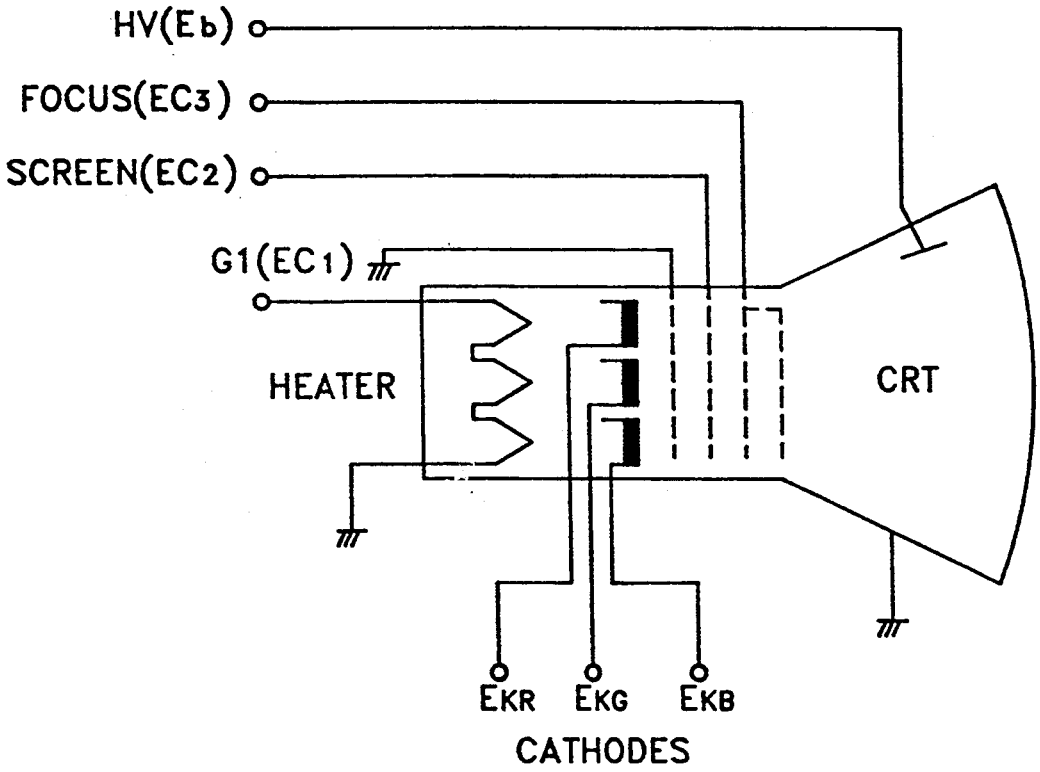
FIG. 2 (PRIOR ART)
FIG.2 shows a conventional display apparatus incorporating the heat-emissive type cathode shown in FIG.1.
Figure 4:
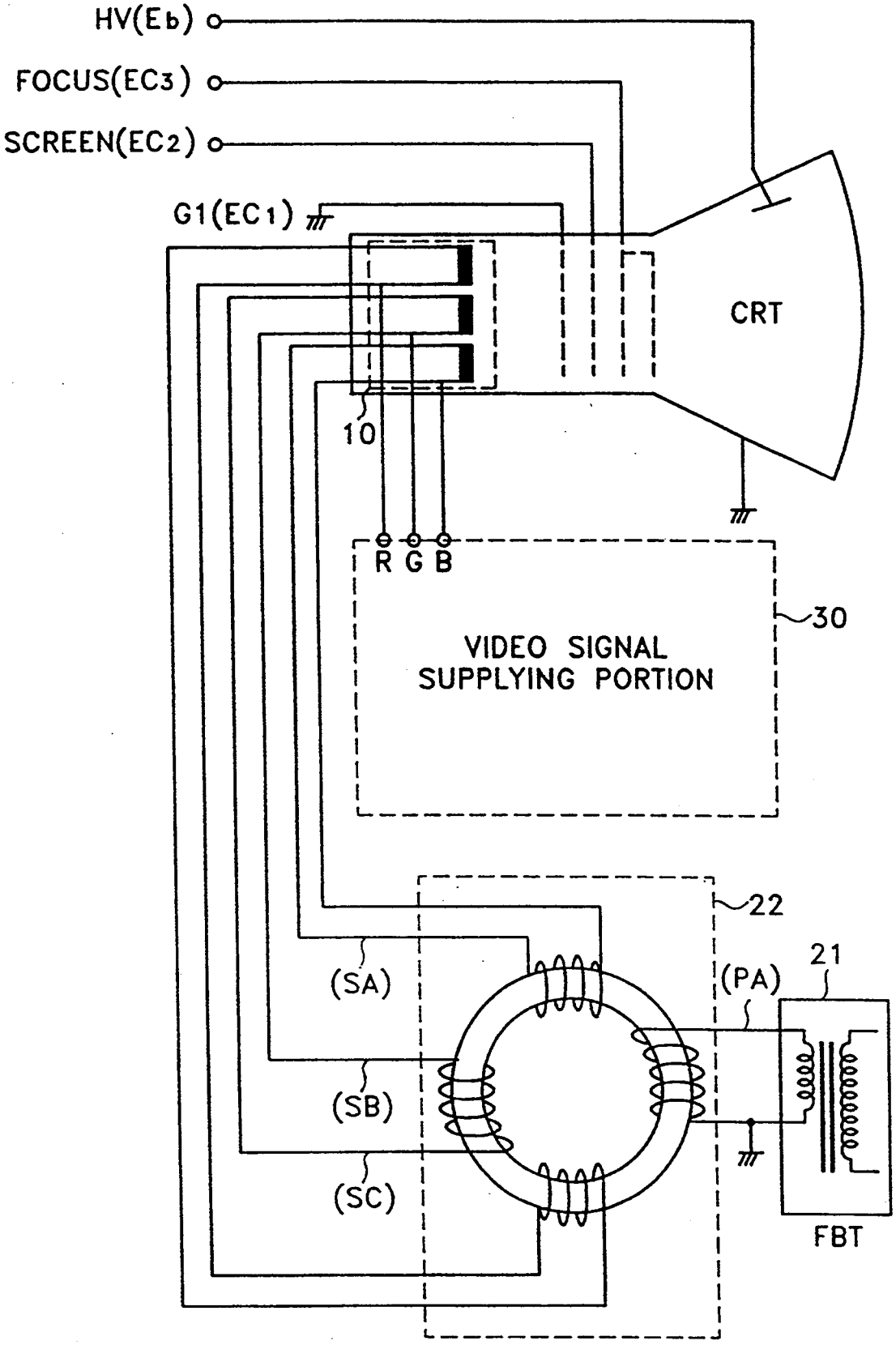
FIG.4 shows a display apparatus for rapidly displaying pictures according to the present invention, adopting the direct-heating type cathode of impregnated structure, as shown in FIG.3.

FIG.4 shows a display apparatus for displaying pictures virtually instantaneously according to the present invention, adopting the direct-heating type cathode of an impregnated structure, as shown in FIG.3. For this embodiment, a color television is used as the display apparatus.

The display apparatus illustrated in FIG.4 comprises a cathode ray tube CRT having a dispenser cathode 10 wherein a cathode material is filled in pores of a porous body and a porous heater is directly connected to the cathode material. The apparatus further includes a voltage generator, which produces a first voltage for driving the heater, and includes a video signal supply portion 30 for supplying a video signal to cathode 10. Also included are a deflector (not shown) for deflecting horizontally and vertically an electron beam generated from cathode 10, to produce a raster by scanning the fluorescent surface of cathode ray tube CRT, and a flyback transformer 21 for generating a second voltage to be supplied to the anode and one or more grids of the cathode ray tube CRT using a horizontal deflection output signal supplied from the deflector.

The voltage generator comprises a heater transformer 22 for transforming the secondary voltage of flyback transformer 21 into a rating voltage and current for driving the heater. Heater transformer 22 comprises a primary winding coil PA, to which the secondary voltage of flyback transformer 21 is applied, and three independent secondary winding coils SA, SB and SC, each of which has windings having the same number of turns for driving the heater.

FIGS.5A to 5C are waveform diagrams for various portions of the display apparatus shown in FIG.4. FIG.5A illustrates a waveform of a signal having a voltage value and a current value of 6.3 Vrms and 600–700 mArms, respectively, and which is produced from the secondary winding coil PA of flyback transformer 21, that is, the primary winding coil of heater transformer 22. FIG.5B illustrates a waveform of each signal that is produced by each of three the secondary windings SA, SB and SC of heater transformer 22. Each has a voltage value of 1Vrms and a current value of 1 Arms. FIG.5C shows a waveform of each of the R, G and B signals applied from the video signal supply portion 30 to dispenser cathode 10.

Figure 6:
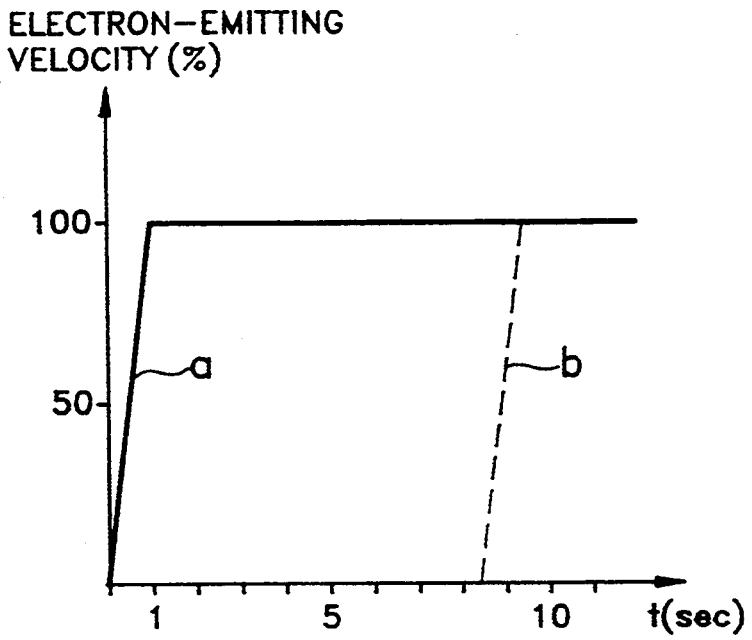
FIG.6 shows a graph comparing an electron-emitting velocity function of the display apparatus of the present invention with that of the conventional art.

FIG.6 is a graph comparing electron-emitting velocity functions for the present invention and the conventional art, wherein the plot line "a" represents the electron-emitting velocity function for the present invention, and the dotted plot line "b" represents the electron-emitting velocity function for the conventional art.

Figure 7:
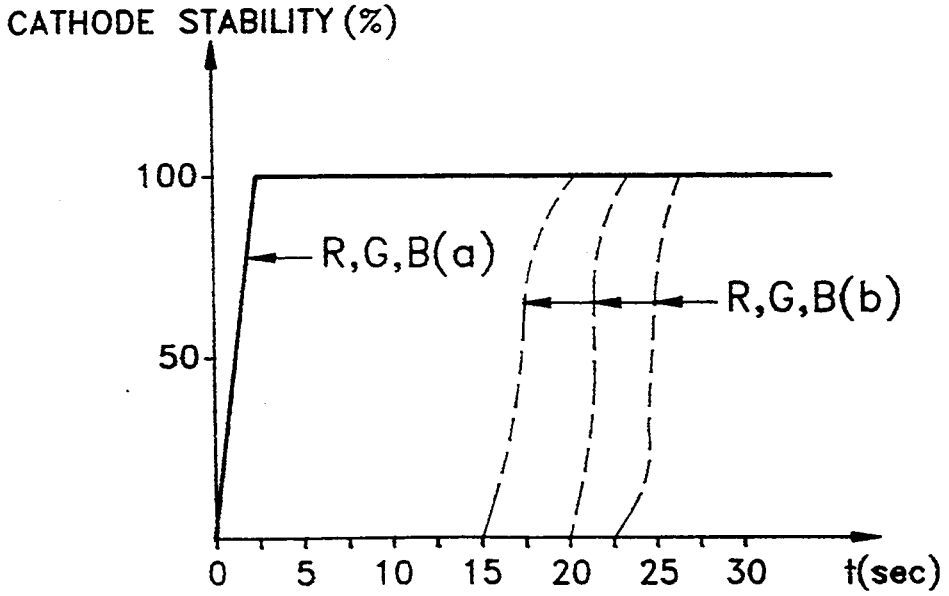
FIG.7 shows a graph comparing a cathode stability function of the display apparatus of the present invention with that of the conventional art.

FIG.7 is a graph comparing the cathode stability function of the present invention with that of the conventional art, wherein the plot line "a" represents the cathode stability function of the present invention, and the dotted plot lines "b" represent the respective stability functions of red, green, and blue cathodes for the conventional art.

Now, operation of the display apparatus according to the present invention is described below with reference to FIGS.3 through 7.

First, referring to FIG.4, heater transformer 22 induces a voltage of about 1 Vrms (in this case, about 1A flows) to each of three independent secondary windings by means of a turn ratio N1/N2 between primary windings N1 and secondary windings N2. A voltage of 21 to 25 Vp-p or 6.3 Vrms (in this case, about 600–700 mA flows) is applied to the primary winding coil of heater transformer 22 via the flyback transformer 21. The voltage induced to the secondary windings of heater transformer 22 is used as power for driving the dispenser cathode 10, where the power consumption is about 1 watt.

Dispenser cathode 10 is structured as shown in FIG.3. When the power produced by the secondary windings of heater transformer 22 is applied to the lower portion of filament 12, the cathode matrix 11, serving as a porous heater, and the filament 12 are turned on simultaneously so as to emit heat. Accordingly, cathode matrix 11 reaches the operating temperature, that is, about 1,000° C., virtually instantaneously. Consequently, the thermions are emitted from cathode matrix 11. The electron-emitting rate reaches the maximum value (100%), within about one second, as illustrated by plot line "a" of FIG.6. Further, a stable state for the red, green and blue cathodes (maximum value 100% ) is obtained within about two or three seconds, as illustrated by plot line "a" of FIG.7.

Video signal supplying portion 30 is a circuit for processing video signals and is used in conjunction with color televisions. Demodulated color difference signals R-Y, G-Y and B-Y are amplified to predetermined video signal levels, respectively. The amplified signals as shown in FIG.5C are then applied to the cathode of dispenser cathode 10.

That is, since the R, G and B video signals are produced in the negative direction below the cut-off voltage for blocking the cathode as shown in FIG.5C, the heater in dispenser cathode 10 is turned on. The blanking signal, which has no video signal information, lies above the cut-off voltage. Since the turn-on interval of the heater substantially equals the blanking interval in a horizontal deflection circuit, even if the heater in dispenser cathode 113 electrically contacts the cathode, the heater can operate so that the voltage for driving the heater in dispenser cathode 10, supplied from heater transformer 22, does not overlap the voltages of the R, G and B video signals produced from video signal supply portion 30.

The present invention has been explained considering only the case where heater transformer 22 is located outside the cathode ray tube CRT. However, it should be noted that the present invention can be adapted equally to the case where heater transformer 22 is installed inside cathode ray tube CRT. It can also be adapted to cases where the secondary windings of a transformer used in the switching mode power supply are used directly, instead of using heater transformer 22. Also, the present invention can be adapted to a monochrome cathode ray tube using only one cathode, as well as to a color cathode ray tube.

As described above, in the display apparatus for rapidly displaying pictures according to the present invention, the electron-emitting velocity function of the electron gun reaches its maximum value within about one second after the power is applied. Therefore, the pictures can be displayed virtually instantaneously. Also, the present invention can be adapted to HDTV, which requires high current density electron-emitting characteristics. Consequently, the white balance performance of an initial picture can be enhanced.

Also, the power consumption used for driving the cathode can be reduced by about 77% in comparison with that of the conventional art. Further, since the heater can be removed, to eliminate a complicated manufacturing process thereof, the time for manufacturing the cathode ray tube can be shortened. Also, the burn-in time for producing the television set or monitor is reduced, so that productivity can be increased.

What is claimed is:

1. A display apparatus for displaying pictures comprising:

a cathode ray tube having a dispenser cathode wherein a cathode material is filled in pores of a porous body and a porous heater is directly connected to said cathode material;

a voltage generator which produces a first voltage for driving said heater;

means for supplying a video signal to said cathode;

deflection means for deflecting horizontally and vertically an electron beam generated from said cathode to produce a raster by scanning the fluorescent surface of said cathode ray tube; and a flyback transformer for generating a second voltage so as to be supplied to an anode and one or more grids of said cathode ray tube using a horizontal deflection output signal supplied from said deflection means, wherein said voltage generator comprises a heater transformer for transforming the second voltage of said flyback transformer into a rating voltage or a rating current for driving said heater, said heater transformer comprising at least one primary winding coil to which the second voltage of said flyback transformer is applied and at least two independent secondary winding coils, all of which have the same number of coil windings.

2. A display apparatus according to claim 1, wherein said heater transformer comprises one primary winding coil and three secondary winding coils.

3. A display apparatus for displaying pictures, comprising:

a cathode ray tube comprising a dispenser cathode, in which pores of a porous body are filled with a cathode material, a heater directly contacting said porous body, an anode, and a grid;

a voltage generator which produces a first voltage for driving said heater;

a video signal supply which supplies video signals to said dispenser cathode;

a deflector which outputs a horizontal deflection output signal and deflects electron beams generated by said dispenser cathode; and a flyback transformer which supplies a second voltage to said anode and said grid using the horizontal deflection output signal supplied from said deflector, wherein said voltage generator comprises a heater transformer for transforming the second voltage of said flyback transformer into a rating voltage or a rating current, for driving said heater, said heater transformer comprising at least one primary winding coil, to which the second voltage of said flyback transformer is applied, and at least two independent secondary winding coils, each of which has the same number of coil windings as the other secondary winding coils.

4. A display apparatus according to claim 3, wherein said heater transformer comprises one primary winding coil and three secondary winding coils.

* * * * *